US009669274B1

(12) United States Patent
Renkis

(10) Patent No.: US 9,669,274 B1
(45) Date of Patent: Jun. 6, 2017

(54) AIR SUSPENSION GOLF BALL PRACTICE TEE SYSTEMS AND METHODS

(71) Applicant: Alexander W. Renkis, Nashville, TN (US)

(72) Inventor: Alexander W. Renkis, Nashville, TN (US)

(73) Assignee: Alexander W. Renkis, Nashville, TN (US)

( * ) Notice: Subject to any disclaimer, the term of this patent is extended or adjusted under 35 U.S.C. 154(b) by 0 days.

(21) Appl. No.: 15/000,079

(22) Filed: Jan. 19, 2016

(51) Int. Cl.
*A63B 69/36* (2006.01)
*A63B 57/00* (2015.01)

(52) U.S. Cl.
CPC ..... *A63B 57/0006* (2013.01)

(58) Field of Classification Search
CPC ..... A63B 57/0006; A63B 57/10; A63B 2069/0077
See application file for complete search history.

(56) References Cited

U.S. PATENT DOCUMENTS 2,051,253 A * 8/1936 Goehler ..... A63B 57/0006 221/251
3,887,182 A * 6/1975 Breslow ..... A63F 7/066 273/450
4,564,195 A * 1/1986 McClure ..... A63B 69/0075 473/418
4,575,080 A * 3/1986 Miles ..... A63B 69/0075 473/418
4,659,081 A * 4/1987 Cook ..... A63B 57/0006 473/133
4,741,537 A 5/1988 Adam
5,011,144 A * 4/1991 Marello ..... A63B 69/0075 446/179
5,052,688 A * 10/1991 Shiau ..... A63B 47/024 473/135
5,071,131 A * 12/1991 Turnidge ..... A63B 57/0006 473/137
5,145,176 A * 9/1992 Lipson ..... A63B 57/0006 273/399
5,160,131 A * 11/1992 Leon ..... A63B 69/409 124/56
5,282,629 A * 2/1994 Eckstein ..... A63B 57/0006 473/133
5,330,194 A 7/1994 Copeland
5,348,305 A 9/1994 Lowe
5,356,148 A * 10/1994 Elder, Jr. ..... A63B 57/0006 473/131
5,390,931 A 2/1995 Chiasson
5,529,307 A 6/1996 Chang
5,643,096 A * 7/1997 Lowe ..... A63B 57/0006 473/134
5,647,805 A 7/1997 Tarbox
5,662,526 A 9/1997 Sutherlin
5,738,593 A 4/1998 Coury et al.
6,419,589 B1 7/2002 Carter
(Continued)

*Primary Examiner* — Steven Wong
(74) *Attorney, Agent, or Firm* — Neo IP

(57) ABSTRACT

The present invention employs air pressure to suspend golf balls practice tees. A supply of golf balls is provided by a weather-resistant funnel connected to a pipe leading underground towards the fan. A sensor is used to determine if a golf ball is currently suspended in air and when to dispense a new ball.

13 Claims, 1 Drawing Sheet

(56) References Cited

U.S. PATENT DOCUMENTS

| | | | | |
|---|---|---|---|---|
| 6,523,718 | B1 * | 2/2003 | Chan | A63B 57/0006 221/271 |
| 6,631,828 | B1 | 10/2003 | Reardon | |
| 6,666,776 | B2 | 12/2003 | Yamaguchi | |
| 6,685,575 | B1 | 2/2004 | Anderson | |
| 7,018,300 | B2 | 3/2006 | Paicos | |
| 7,846,045 | B1 * | 12/2010 | Kendall | A63B 69/0075 473/417 |
| 2003/0186752 | A1 * | 10/2003 | Yamaguchi | A63B 47/002 473/134 |
| 2004/0259652 | A1 * | 12/2004 | Paicos | A63B 57/0006 473/135 |
| 2005/0192110 | A1 * | 9/2005 | Regev | A63B 57/0006 473/135 |
| 2007/0238554 | A1 * | 10/2007 | Hu | A63B 69/0075 473/417 |
| 2008/0009373 | A1 * | 1/2008 | Binder | A63B 69/409 473/418 |
| 2010/0099520 | A1 * | 4/2010 | Auzoux | A63B 67/06 473/417 |
| 2011/0306435 | A1 * | 12/2011 | Seo | A63B 24/0003 473/221 |
| 2015/0051019 | A1 | 2/2015 | Duncan et al. | |
| 2015/0051020 | A1 | 2/2015 | Duncan et al. | |
| 2015/0051021 | A1 | 2/2015 | Duncan et al. | |

* cited by examiner

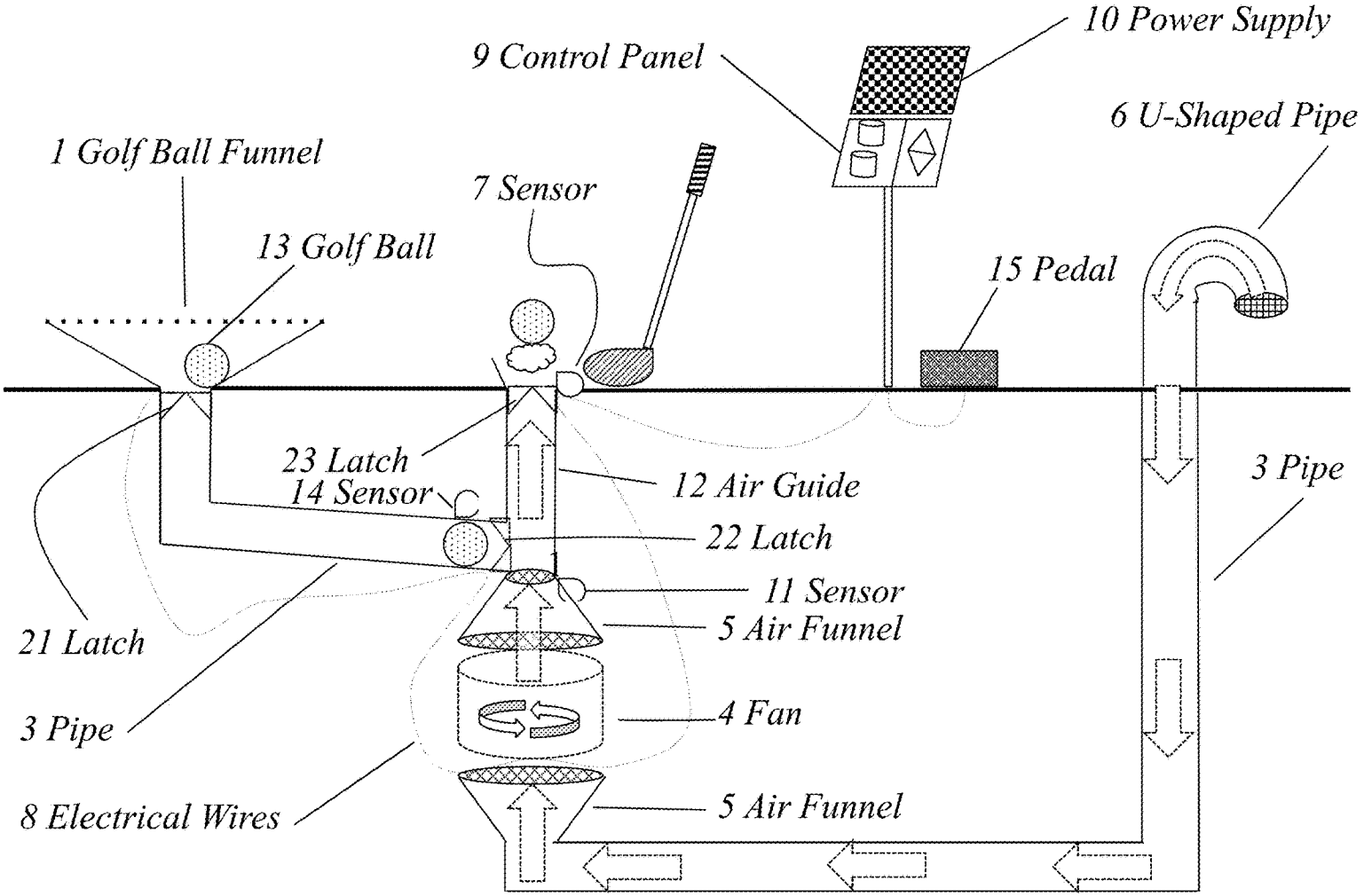
10 Power Supply
6 U-Shaped Pipe
3 Pipe
15 Pedal
9 Control Panel
12 Air Guide
22 Latch
11 Sensor
5 Air Funnel
4 Fan
5 Air Funnel
7 Sensor
23 Latch
14 Sensor
13 Golf Ball
1 Golf Ball Funnel
21 Latch
3 Pipe
8 Electrical Wires

AIR SUSPENSION GOLF BALL PRACTICE TEE SYSTEMS AND METHODS

BACKGROUND OF THE INVENTION

1. Field of the Invention

The present invention is generally directed to a golf ball practice tee, and more particularly, to an air suspension golf ball practice tee systems and methods that allow for hands-free teeing up of a golf ball from a localized ball supply and controls at a practice tee area.

2. Description of the Prior Art

Generally, it is known in the prior art to provide golf ball practice tees for use at driving ranges. Driving ranges typically employ wooden, plastic, or rubber golf ball practice tees. Due to the continuous use of golf ball practice tees, the rubber tees become damaged and cannot support a golf ball; wooden or plastic tees damage or break and create waste that litters the practice tee area. Furthermore, the use of a physical golf ball tee makes the user bend down and place a new golf ball following each swing, which is time-consuming and disrupts the ability of the user to repeat each practice swing. Different golf ball practice tee systems of the prior art have been described in order to solve these various problems.

Representative examples of prior art include the following patent documents:

U.S. Pat. No. 4,741,537 for teeing device by inventor Adam filed Sep. 3, 1985 and issued May 3, 1988 is directed to an apparatus for semiautomatically teeing up golf balls utilizing very low air pressure as an operating medium. Balls are loaded onto a contoured dish at the upper end of an open ended upright cylinder and pass from the dish into a flexible tube wrapped helically around the outside of the cylinder. The lower end of the tube is blocked by a ball dispenser. When a user trips a lever on the ball dispenser, one ball is permitted to roll to a stop above a hole in the hitting mat directly above the air operated teeing device. The teeing device includes a teeing tube attached vertically above an expandable chamber and extending just to the top surface of the hitting mat. A very low pressure stream of air constantly flows through the chamber and escapes via the teeing tube. When a golf ball comes to rest above the teeing tube, the escape of air is terminated, causing the expandable chamber to fill, thereby raising the teeing tube and the ball to the teed height. When the golf ball is struck from the teeing tube, the air again escapes from the expandable chamber, causing the teeing tube to recede into the hole in the hitting mat ready for the next ball to be teed.

U.S. Pat. No. 5,145,176 for pneumatically operated golf ball tee by inventor Lipson filed Jul. 31, 1991 and issued Sep. 8, 1992 is directed to a pneumatically operated golf ball tee system of the present invention comprises an upwardly opening ball and air guide through which the ball passes and above which the ball is pneumatically supported when in a teed position. The system further includes a source of golf balls, a control for ball entry from the source to the guide and an air supply providing pressurized air upwardly through the guide.

U.S. Pat. No. 5,282,629 for automatic golf ball teeing apparatus by inventor Eckstein filed Nov. 23, 1992 and issued Feb. 1, 1994 is directed to an automatic golf ball teeing apparatus using a pivot linkage which connects a tee cylinder and an air cylinder. The pivot linkage extends in a first direction approximately orthogonal to a second direction in which the tee cylinder reciprocates. A tee is coupled to the tee cylinder and thus reciprocates with the tee cylinder. The pivot linkage minimizes the height of the automatic golf ball teeing apparatus since the air cylinder is not located axially beneath the tee cylinder.

U.S. Pat. No. 5,330,194 for golf ball delivery device by inventor Copeland filed Apr. 5, 1994 and issued Jul. 19, 1994 is directed to a golf ball delivery device having a housing, a ball feeder adjacent to a housing for supplying the delivery device with balls, a ball channel integral to the housing for guiding balls from the feeder to a tee, a tee for supporting a ball, a piston attached to the tee for reciprocating the tee from ball receiving position to ball driving position, a delivery mechanism for incrementally delivering balls to the tee, the further improvement comprising a pivot handle in communication with the piston for activating the delivery device.

U.S. Pat. No. 5,348,305 for golf ball teeing apparatus by inventor Lowe filed Dec. 17, 1992 and issued Sep. 20, 1994 is directed to a golf ball teeing apparatus for continuous teeing of a supply of golf balls for driving or the like is presented. The golf ball teeing apparatus includes a platform, a housing having two chambers, a reciprocable pair of camming plates with angular upper camming surfaces, a piston with a tee mounted thereon and an actuator. Each of the reciprocable camming plates are adapted for sliding through one of the two chambers. The housing also includes an input which communicates with a first of the two chambers wherein a first of the two reciprocable camming plates is located. Located within a second chamber is the piston which is adapted for slideably engaging the upper camming surface of a second camming plate. After entering the housing through the input and upon actuation of the first and second reciprocable camming plates, a golf ball is slid upwardly along the upper camming surface of the first camming plate within the first chamber of the housing as the piston and tee slides downwardly along the upper camming surface of the second camming plate within the second chamber of the housing. Once the golf ball reaches the apex of the upper surface of the first camming plate, it rolls downwardly onto the tee. The piston and tee are then moved back upwardly by a return of the reciprocable plates and is ready to be struck by a golfer.

U.S. Pat. No. 5,356,148 for simplified mechanism for automatically teeing practice golf balls by inventor Elder, Jr. filed Aug. 3, 1993 and issued Oct. 18, 1994 is directed to a hopper into which a bucket of balls can be poured, a trough which receives the balls from the hopper and aligns them in single file for feeding to the teeing device; the trough is connected to a silo into which the balls are fed, one at a time to rest on a tee. A pneumatic device raises the tee to a position slightly higher than ground level so that the ball may be struck by the golfer on his practice swing. The golfer then taps a switch which causes the teeing mechanism to retract and receive another ball from the trough. The device then automatically releases to force the ball up the silo and into the teed position.

U.S. Pat. No. 5,390,931 for golf ball tee device by inventor Chiasson filed Apr. 20, 1994 and issued Feb. 21, 1995 is directed to an automatic golf ball teeing device in which golf balls are fed to a tee for driving. The device is in the form of a portable platform that may be moved to desired locations. The design of the automatic golf ball feeding mechanism permits a shallow platform raised a minimum amount above the ground.

U.S. Pat. No. 5,529,307 for automatic golf ball dispenser by inventor Chang filed Jan. 23, 1995 and issued Jun. 25, 1996 is directed to an automatic golf ball dispenser includes a housing having a substantially horizontal top and a plurality of substantially vertical sides. Within the housing is a storage bin and track configured to receive a plurality of golf balls and to deliver the golf balls to a feed mechanism. The feed mechanism includes a meter configured to dispense a single golf ball for each movement of the meter. An arm mounted on a pivot retrieves the single golf ball from the feed mechanism and places the golf ball at a predetermined location for a golfer to hit the golf ball. A sensor is located nearby to indicate when another golf ball should be dispensed. A controller is also contained within the housing and configured to accept currency, where the controller is electrically connected to the sensor and responsive to the sensor, and where the controller is also electrically connected to an arm motor to control the movement of the arm. In another aspect of the invention, a solar panel is added as a backup power source, and as a way to recharge an internal battery. In another aspect of the invention, a network of pipes distributes golf balls to a plurality of golf ball dispensers.

U.S. Pat. No. 5,647,805 for golf teeing device by inventor Tarbox, Jr. filed Apr. 22, 1996 and issued Jul. 15, 1997 is directed to a lightweight and portable system to place a golf ball onto a tee. The present invention comprises a housing which has a hopper bin defined in the upper region thereof. The hopper is designed to accommodate up to four dozen golf balls at a time so that a golfer may "drive" numerous times without having to stop often and reload the hopper. Preferably, the interior of the hopper bin is sloped to form a rough funnel shape such that the golf balls are distributed one-at-a-time into a trough which is coupled to the hopper. Internal of the housing is the apparatus by which the golf balls are distributed single file through a delivery tube to the specialized ball placement mechanism. The most significant features of the present invention is the specialized ball placement mechanism which permits a golfer to tee their ball prior to driving at varying heights and the lever mechanism which allows a golfer to rapidly dispense a practice ball without drastically altering his stance or changing his grip. In particular, at the distal end of the ball placement mechanism is a pivotally connected roughly crescent shaped ball receptacle. This ball receptacle cradles the golf ball in two curved prongs or fingers.

U.S. Pat. No. 5,662,526 for automatic golf ball teeing machine by inventor Sutherlin filed Apr. 2, 1996 and issued Sep. 2, 1997 is directed to an automatic golf ball teeing machine is constructed around a housing that includes a substantially horizontal plate. A fluid pressure cylinder with an inlet and a piston above the inlet is attached to the housing under a hole in the plate. The piston is moveable between an advanced position and a retracted position, but is biased toward its retracted position. A tee is connected to the piston and is moveable with the piston between a loading position and a maximum height position in which a portion of the tee extends above the plate. A supply conduit sized to carry golf balls is attached to the housing with one end adjacent the tee when in its loading position. A source of high pressure fluid is connected to the inlet of the fluid pressure cylinder. A pressure regulating valve is positioned between the inlet and the source of high pressure fluid and is capable of adjusting pressure acting on the piston to balance the tee between its loading position and its maximum height position. A reset switch is capable of relieving pressure on the piston to allow the piston to retract under its biasing action in order to load the next available golf ball.

U.S. Pat. No. 5,738,593 for apparatus and method for introducing golf balls to an air driven transportation system by inventors Coury and Coury filed Jan. 21, 1997 and issued Apr. 14, 1998 is directed to air flowing in a transportation conduit delivers golf balls from a central repository to dispensers located throughout a driving range. An apparatus for introducing the golf balls into this flowing stream of air includes a valving system capable of introducing batches of balls in an air stream flowing in a substantially horizontal direction. The valving system is controlled by a compressor and timer. An optional vacuum system is provided to deliver the golf balls to the apparatus for introducing the golf balls into the air stream in those situations where gravity cannot be relied upon to deliver the golf balls to the entrance of the apparatus.

U.S. Pat. No. 6,419,589 for automatic golf ball placement device by inventor Carter filed Jun. 20, 2000 and issued Jul. 16, 2002 is directed to an automatic golf ball placement device having a storage tube for holding a quantity of golf balls preparatory for placement onto a tee. One end of the tube receives the balls for storage while the opposite includes an opening for dispensing the first ball into a rotatable receiver for transfer to a dispensing shoot for delivery to the tee. The receiver is weighted so that upon placement of a ball on the tee, the receiver revolves back to the storage tube for accepting the next ball for dispensing onto the tee. A pedal attached to the receiver is actuated by a player's foot or engagement with a golf club to urge rotation of the receiver to dispense the first ball.

U.S. Pat. No. 6,631,828 for golf ball and tee placement unit by inventor Reardon filed Jan. 23, 2002 and issued Oct. 14, 2003 is directed to a golf/tee placement device having a housing 32 having a hopper 18 therein for the placement of a plurality of golf balls 14 and a canister for the placement of a plurality of tees 16. The housing uses compressed air to move a golf ball 14 and golf tee 16 away from the device and drive the tee 16 into the ground with the golf ball 14 placed thereon. Positioned on the exterior face of the housing 32 is a control panel 26 with user selectable variables such as the depth of the golf tee and the time duration for the placement of subsequent balls and tees. The device moves a tee 16 into the extending placement arm 22 using compressed air. In conjunction with the loading of the tee 16 a single ball 14 is released into the placement arm 22. Once positioned the placement arm 22 uses compressed air to extend it to full position whereupon a jet of compressed air drives the ball 14 and the tee 16 into the ground while opening the hinged element which retracts leaving the golf ball 14 and implanted tee 16 behind.

U.S. Pat. No. 6,666,776 for tee device for sport practice by inventor Yamaguchi filed Mar. 29, 2002 and issued Dec. 23, 2003 is directed to an automated tee device uses air pressure through a tee to determine whether a ball is rested on the tee or whether a next ball should be supplied. When a ball is in a rest position on the tee, the airflow through a passage within the tee is inhibited. Consequently, by determining the current condition of airflow through the tee, it can be determined whether a ball is rested on the tee or whether a next ball should be supplied. In accordance with a second aspect of the invention, the tee can be adjusted to any height within a preselected vertical range. Upper and lower limit switches reverse the adjustment of a tee height in response to determining that the upper or the lower limit of the range has been reached. The automated tee device may be used in sports such as golf, baseball and softball.

U.S. Pat. No. 6,685,575 for portable automatic golf ball teeing device by inventor Anderson filed Oct. 17, 2002 and issued Feb. 3, 2004 is directed to a portable device capable of placing a golf ball on a tee repeatedly without the interaction of the user. The device consists of a base, a ball storage hopper, a ball scoop leading to an arm, a control system including a control panel, a rechargeable battery, an artificial turf mat with a rubber tee, a handle and wheels, and a housing to enclose the device. The user loads golf balls into the storage hopper where they roll down a track to the ball scoop. A sensor signals when a new ball is needed, and a motor lowers the arm which is connected to the ball scoop. When the arm is at its lowest position the ball rolls down the arm to the tee. When the ball is hit off the tee, a new ball is automatically placed on the tee.

U.S. Pat. No. 7,018,300 for golf ball teeing up device by inventor Paicos filed Jan. 6, 2004 and issued Mar. 28, 2006 is directed to an automatic golf ball teeing up device for use by a golfer at driving ranges, and other facilities. The teeing up device includes a pair of holding cylinders, a pneumatic cylinder, and a photoelectric sensor in communication with a timer and relay. A holding cage and tube gravity feed golf balls one at a time past the holding cylinders into a loading chamber. The pneumatic cylinder has a piston rod having a tee thereon, which extends upwardly through the loading chamber to tee up the golf ball. The photoelectric sensor has a photoelectric eye and reflector axially aligned with the teed up golf ball therebetween. When the golf ball is removed from the tee, the photoelectric eye and reflector connect to signal the timer and relay to actuate the holding cylinders and pneumatic cylinder to feed and tee another golf ball.

US Patent Application Publication No. 2015/0051019 for active golf tee by inventors Duncan et al. filed Aug. 15, 2013 and published Feb. 19, 2015 is directed to systems and methods associated with a golf tee configured to impart a spin to a golf ball prior to impact between the golf ball and the golf club face. The golf tee includes a retention mechanism configured to releasably secure a golf ball to a contact surface of the golf tee while a rotation mechanism rotates the golf tee or a spin mechanism spins the golf ball, thereby imparting spin to the golf ball. The golf tee may further include a processing unit configured to control the retention mechanism and rotation mechanism or spin mechanism. The processing unit may communicate with various external or local sensors, for example, a swing sensor, an environmental sensor, or the like, to control the golf tee to spin the golf ball to achieve a particular post impact trajectory.

US Patent Application Publication No. 2015/0051020 for active golf tee by inventors Duncan et al. filed Aug. 15, 2013 and published Feb. 19, 2015 is directed to systems and methods associated with a golf tee configured to reduce or eliminate spin imparted on a golf ball due to friction between a contact surface of the golf tee and the golf ball. In one embodiment, the golf tee includes a retracting mechanism to retract the support member of the golf tee prior to impact between the golf club face and the golf ball, at least one swing sensor to measure motion parameters of an approaching golf club, and a processing unit to control the retracting mechanism based on the measured motion parameters. In another embodiment, the golf tee includes a contactless support mechanism to support the golf ball, a position sensor to detect a position of the golf ball, and a processing unit to control the support mechanism, based on data from the position sensor, to manipulate the position of the golf ball.

US Patent Application Publication No. 2015/0051021 for active golf tee by inventors Duncan et al. filed Aug. 15, 2013 and published Feb. 19, 2015 is directed to a golf tee configured to control spin imparted on a golf ball due to friction between a contact surface of the golf tee and the golf ball. In one embodiment, the golf tee includes a plurality of support members to support a golf ball, wherein contact between the golf ball and the plurality of support members is asymmetrically distributed between a first contact area and a second contact area. In another embodiment, the golf tee includes a two-part shaft slideably coupled together and an adjustable resistance mechanism to provide a resistive force between the two parts of the golf tee, wherein the resistive force opposes the sliding together of the two parts. The resistance mechanism may be manually or automatically to control spin imparted to the golf ball due to friction between a contact surface of the golf tee and the golf ball.

The prior art is limited regarding air suspension golf ball practice tees with extensive underground funnel systems. The prior art is further limited with complicated golf ball teeing devices that require numerous parts and are too expensive and unreliable.

SUMMARY OF THE INVENTION

The present invention is generally directed to air suspension golf ball practice tees. Furthermore, the invention is directed to air suspension golf ball practice tees with underground funnel systems that allow for hands-free teeing up of a golf ball, including a localized ball supply and controls at a practice tee area proximal to the air suspension tee. Also, the present invention provides methods for using golf ball practice tees having air suspension of one golf ball at a time, which is fed from a localized ball supply and controls at a practice tee area.

These and other aspects of the present invention will become apparent to those skilled in the art after a reading of the following description of the preferred embodiment when considered with the drawings, as they support the claimed invention.

BRIEF DESCRIPTION OF THE DRAWINGS

The FIGURE illustrates a front view diagram of a system for air suspension golf practice tee for a localized ball supply and controls proximal to a practice tee area the present invention.

DETAILED DESCRIPTION

The present invention provides systems and methods for air suspension golf ball practice tees that allow for hands-free teeing up of one golf ball at a time in series, fed from a localized ball supply and controls at a practice tee area.

In a preferred embodiment, the air suspension golf ball practice tee includes an upwardly opening ball and air guide 12 through which a ball passes and above which the ball remains in air suspension when in a teed position, a golf ball funnel 1, an underground ball supply pipe 3 that connects said golf ball funnel to said upwardly opening ball and air guide, a sensor 7, at least one latch 22, an air fan 4, a U-shaped pipe 6 to pull in air, a controller 9 and a power supply 10. The golf ball funnel acts as the source of the golf balls 13. The golf ball funnel is weather-resistant and holds a multiplicity of golf balls, preferably up to 50 golf balls at one time. The sensor 7 determines if a golf ball is currently suspended in air. When the sensor 7 does not detect a golf ball suspended in the air tee, the controller 9 causes a next ball to be dispensed by at least one latch mechanism 22 that controls movement of the golf ball from the golf ball funnel to air suspension when in a teed (or air tee) position. The air fan 4 pressurizes air to allow for the golf ball to remain in air suspension when in a teed (or air tee) position. Finally, the controller allows a user to control the height of the golf ball in the air suspension or in the air tee position.

The FIGURE illustrates a front perspective view of a preferred embodiment of the present invention. For use at driving ranges, the device uses air pressure to suspend golf balls for a user to hit. The machine works underground, pulling in air through an air inlet pipe 6 on the surface to be used by the underground fan 4. The end of the air inlet pipe is protected to prevent rain, leaves and other undesirable environmental factors from entering the pipe, while allowing air in. For example, the end of the air inlet pipe is an inverted U-shape. In an alternative embodiment, an air compressor or supply of compressed air is constructed and configured in connection with the pipe, air funnel, and controls for providing the air suspension tee and its ball height control. A localized (in close proximity to the air tee area) golf ball supply is loaded with golf balls into a golf ball funnel 1 that is connected to a feeder pipe 3 leading underground (downward sloped for gravity feed) towards a latch or control valve 22. The present invention uses at least one latch mechanism to prevent balls from entering the upwardly opening ball and air guide 12. Two air funnels 5 are positioned above and below a fan 4 with the larger open end facing the fan for each of the air funnels as illustrated in the FIGURE, for channeling air from the air input and/or compressed air supply. Continuous air is preferred, compared with prior art pressurized air that is only provided long enough to hold the ball on an air tee. As illustrated, the at least one latch 21-23 (three are illustrated, one latch 21 from the exit of the funnel, one latch 22 from the exit of the feeder pipe, one latch 23 at the base of the air exit at an air tee position) restrict the movement of the golf balls at the feeder pipe 3 and golf ball supply funnel 1, beside the fan 4, and before the surface or air tee position. A sensor 7 is used determine if a golf ball is currently suspended in air, at what height from the ground or surface, and when to dispense a new ball. In an alternative embodiment, a second sensor 11 determines when a new ball has dropped into the air funnel. During operation, when the sensor 7 does not sense a ball, the fan 4 stops and latch 22 opens, allowing a ball to roll into the air guide. Once the sensor 11 senses the ball, latch 22 closes and the fan resumes operation, sending the ball to the top of the air guide. In another alternative embodiment, a third sensor 14 determines if a ball is in the feeder pipe. If there is no ball, the controller opens latch 21 to allow a ball to enter the feeder pipe.

Through electrical wires 8, all of the latches 21-23 and the fan 4 connect to a controller 9 above ground; alternatively, the controller is a non-display controller. It is not supported above ground with a visible display as in the FIGURE, but is accessible via a smart phone or mobile computing device including a software application (App) for remote control of the system, including its activation, deactivation, and settings. For the App implementation, a user profile may be created and saved to provide automation for air tee height settings, including present settings and past settings within a predetermined time period for the user profile. Additionally or alternatively, the system can be activated by a pedal 15. Thus, there are three ways to control the base: buttons, pedals (foot control) and the app. Preferably, each of the control means are possible, the use will depend on the range.

A power supply 10 provides electricity to the system, including the controller, fan, latches and sensors. The power supply can be any type, including battery, electric grid and/or solar cell.

By contrast to the prior art, the present invention employs air funnels instead of an air jet, which has less control of the air tee and ball air suspension. Also, prior art systems include distributed, multi-channel feeder systems that are not localized for practice and require complex underground distributed systems for sourcing golf ball supply and feeding to the air tee. Additionally, the present invention provides for golf ball sensor that is exterior to the feeder tube and air funnels and pipes; the exterior sensor provides for optical sensors, which can accurately determine the air tee height (ball height suspended in air tee position). By contrast, the prior art includes sensors that are interior to the tubing or channels underground. The air pressure is manually adjustable by users in the prior art, which can be difficult to control ball height. The present invention provides for automated controls wherein the user inputs a user profile and/or preferred setting(s) for air tee height (ball height from ground to suspension in air tee position). The sensor detects environmental conditions and the system comes with presets for certain environmental conditions.

The fan is preferably sized and configured to be replaced by insertion/withdrawal through the air guide 12, such that there is no need to excavate the system.

The above-mentioned examples are provided to serve the purpose of clarifying the aspects of the invention, and it will be apparent to one skilled in the art that they do not serve to limit the scope of the invention. By way of example, the present invention may employ at least four latches. Also by way of example, the golf ball funnel may be weather-resistant. By nature, this invention is highly adjustable, customizable and adaptable. The above-mention examples are is just some of the many configurations that the mentioned components can take on. All modifications and improvements have been deleted herein for the sake of conciseness and readability but are properly within the scope of the present invention.

What is claimed is:

1. A method for air suspension of a golf ball over a golf ball practice tee comprising:

providing a golf ball practice tee including:

an upwardly opening ball and air guide through which a ball passes and above which the ball remains in air suspension when in a teed position;

a golf ball funnel, an underground supply line, a fan positioned below the upwardly opening ball and air guide, an above ground U-shaped air intake pipe, a controller;

gathering golf balls in a wide end of the golf ball funnel;

supplying the golf balls from a narrow end of the golf ball funnel to the underground golf ball supply line connected to the narrow end of the golf ball funnel by a first end of the underground golf ball supply line via activation of at least one first latch, wherein the at least one first latch is positioned within the underground golf ball supply line and positioned between the first end of the underground golf ball supply line and the narrow end of the golf ball funnel;

supplying the golf balls from the underground golf ball supply line to the upwardly opening ball and air guide connected to a second end of the underground golf ball supply line via activation of at least one second latch positioned within the underground golf ball supply line and positioned between the second end of the underground golf ball supply line and the upwardly opening ball and air guide;

measuring from at least one air flow sensor air flow into the upwardly opening ball and air guide;

detecting from at least one position sensor the position of the golf balls in the golf ball funnel and underground golf ball supply line;

producing air from the fan positioned below the upwardly opening ball and air guide by bringing in outside air from a channel piping with a first end connected to the above ground U-shaped air intake pipe and a second end positioned below the fan, wherein the fan pulls the air through the U-shaped air intake pipe and the air channel piping, moving the air through the upwardly opening ball and air guide, thus creating negative pressure through the upwardly opening ball and air guide; and accelerating the air from the fan through the air funnel, concentrating it into the upwardly opening ball and air guide;

wherein operation of the golf ball practice tee is managed with the controller for increasing and/or decreasing air flow and opening and/or closing the at least one first latch and/or the at least one second latch.

2. The method of claim 1, wherein the top of the golf ball funnel is approximately level with the top of the upwardly opening ball and air guide.

3. The method of claim 1, wherein the controller automatically controls the height of the golf ball in air suspension when in a teed position.

4. An air suspension golf ball practice tee system comprising:

an above ground U-shaped air intake, a below ground air intake guide, an air fan, an air funnel, an upwardly opening ball and air guide, a golf ball feeder funnel, an underground golf ball supply line, wherein the above ground U-shaped air intake and the below ground air intake guide for supplying air to the air fan accelerating the air through the air funnel and through the upwardly opening ball and air guide through which a golf ball passes and above which the golf ball remains in air suspension when in a teed position;

wherein the top of the golf ball feeder funnel is approximately level with the top of the upwardly opening ball and air guide;

wherein the underground golf ball supply line connects the golf ball feeder funnel to the upwardly opening ball and air guide;

at least one first latch, positioned inside the underground supply line and connected between the golf ball feeder funnel and the underground supply line, controlling the movement of the golf ball from the golf ball feeder funnel to the underground supply line;

at least one second latch, positioned inside and connected between the underground supply line and the upwardly opening ball and air guide, controlling the movement of golf balls through the underground supply line to the upwardly opening ball and air guide;

at least one third latch, positioned inside and at the top of the upwardly opening ball and air guide restricting movement of the golf ball at an air tee position;

at least one first sensor positioned for detecting the presence of the golf ball and for determining ball height when suspended in air above the ground;

at least one second sensor is positioned for measuring the air flow through the upwardly opening ball and air guide;

at least one third sensor is positioned for detecting the golf ball when the golf ball is positioned between the underground supply line and the upwardly opening ball and air guide; and a controller capable of adjusting the air flow and thus the height of the golf ball on the air suspension golf ball practice tee and of operating the at least one first latch, the at least one second latch, and the at least one third latch; wherein the air fan channels air to allow for the golf ball to remain in air suspension when in a teed position.

5. The system of claim 4, wherein the golf ball funnel acts as the source of the golf balls.

6. The system of claim 4, wherein the golf ball funnel has a capacity of about 20 to about 50 golf balls.

7. The system of claim 4, wherein the controller automatically controls the height of the golf ball in air suspension when in a teed position.

8. The method of claim 1, wherein the at least one first latch controls the flow of golf balls from the golf ball funnel and the at least one second latch controls the flow of golf balls to the upwardly opening ball and air guide and at least one third latch controls opening and/or closing the top of the upwardly opening ball and air guide; wherein when the at least one third latch is open, continuous air flows upward through the guide.

9. The method of claim 1, wherein the controller is a mobile computing device with a software application for remote control including activation, deactivation, and settings.

10. The method of claim 1, further comprising an interface to the controller wherein the air suspension golf ball practice tee is managed using buttons, pedals or a software application.

11. The method of claim 1, wherein the setting of the ball height is achieved through an automated calculation given the conditions at the at least one sensor to provide the air flow to the upwardly opening ball and air guide.

12. The method of claim 1, wherein the fan is replaceable by insertion and withdrawal through the upwardly opening ball and air guide.

13. The method of claim 1, wherein the upwardly opening ball and air guide is underground in dirt.

* * * * *